US010202943B2

(12) United States Patent
Suzuki

(10) Patent No.: US 10,202,943 B2
(45) Date of Patent: Feb. 12, 2019

(54) DEVICE FOR ADJUSTING ADJUSTMENT VALVE IN CARBURETOR

(71) Applicant: ZAMA JAPAN KABUSHIKI KAISHA, Iwate (JP)

(72) Inventor: Daisuke Suzuki, Hachimantai (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 64 days.

(21) Appl. No.: 15/607,012

(22) Filed: May 26, 2017

(65) Prior Publication Data

US 2018/0252185 A1 Sep. 6, 2018

(30) Foreign Application Priority Data

Mar. 2, 2017 (JP) ..... 2017-39518

(51) Int. Cl.

| | |
|---|---|
| ***F02M 19/04*** | (2006.01) |
| ***F02M 7/06*** | (2006.01) |
| ***F02M 9/08*** | (2006.01) |
| ***F02M 3/10*** | (2006.01) |

(52) U.S. Cl.

CPC ..... *F02M 19/04* (2013.01); *F02M 3/10* (2013.01); *F02M 7/06* (2013.01); *F02M 9/08* (2013.01)

(58) Field of Classification Search

CPC .. F02M 3/10; F02M 7/06; F02M 9/08; F02M 19/04

USPC ..... 261/35, 44.6, 44.8, 69.1, DIG. 38

See application file for complete search history.

(56) References Cited

U.S. PATENT DOCUMENTS 9,856,827 B2 * 1/2018 Xue ..... F02M 3/10

* cited by examiner

*Primary Examiner* — Robert A Hopkins
(74) *Attorney, Agent, or Firm* — One LLP

(57) ABSTRACT

An adjustment device for a carburetor adjustment valve includes a limit cap and a sleeve to prevent over-operation and destruction. The limit cap having first and second projecting parts formed in the insertion hole. The first projecting part engages a first groove on the shaft part of the adjustment valve to hold the limit cap in a first position where the limit cap and adjustment valve rotate freely relative to the sleeve. The second projecting part holds the limit cap in a second position pushed in from the first position where the adjustment valve having a limited range of rotation. The limit cap has an outer circumferential locking part formed on the outer circumference and the sleeve has an inner circumferential locking part formed on its inner circumference. In the second position, the inner circumferential locking part locks the outer circumferential locking part and prevents rotation of the limit cap.

12 Claims, 8 Drawing Sheets

DEVICE FOR ADJUSTING ADJUSTMENT VALVE IN CARBURETOR

TECHNICAL FIELD

The embodiments disclosed herein concern a device for adjusting the adjustment valve in a carburetor having a fuel adjustment function which can adjust the fuel flow by hand in a carburetor which is suitable for feeding fuel to general-purpose engines used for motive power, such as agricultural or gardening machinery, etc.

BACKGROUND TECHNOLOGY

Carburetors which feed fuel to general-purpose engines feed very small fuel flow quantities, compared with carburetors which feed fuel to four-cycle engines, such as automobile engines, and there are great change ratios in the fuel flow quantity, which depend on deviations in the positions or dimensions of various parts or differences in the quality of the parts. In addition, there are differences in the performances of the engines to which the fuel is fed. Therefore, the fuel flow quantity must be adjusted individually.

Therefore, manual adjustment valves, which are made so that the fuel flow quantities can be adjusted individually, are placed in the main fuel path and the low-speed fuel path. These adjustment valves consist of a needle-shaped valve body which is inserted in the fuel path and continuously changes its effective area, a screw part which is joined with the main body of the carburetor by screwing and can be moved forward and backward while this valve body is rotated, and a head part, which is exposed outside of the main carburetor body and has the purpose of rotating the screw part.

These adjustment valves are supplied to general users in a state in which the adjustment operations are fundamentally performed by the manufacturers of the carburetors and the engines or the machinery in which they are assembled, and they are adjusted to the optimum fuel flow quantities. However, the valves may be operated in cases in which the users think that the performances of the engines need to be maintained in response to changes in the places or conditions in which the users use them, for example, changes in air pressure, or they think that temporary malfunctions in the engines need to be corrected or their performances improved. As a result of the carburetor being adjusted outside its range of adjustment and the air-fuel mixture being made too lean or too rich, troubles such as a reduction of output, a worsening of the state of the exhaust, and engine stoppage can be produced.

On the other hand, exhaust regulations are now being imposed even on general-purpose engines; therefore, the adjustment valves which manufacturers have adjusted within ranges which conform to these exhaust regulations are required to have adjustment devices which impose means of limitation in such a way that users cannot adjust them outside these conformance ranges.

As an adjustment device which has a means of limitation such that the adjustment valves in such carburetors cannot be operated above a certain point, Japanese Patent No. Showa 47-42424 (Patent Reference 1), for example, discloses a limit cap which has an arm which projects in a radial direction and is installed on the head of the adjustment valve; the valve can only be operated within one rotation due to its touching the main carburetor body, which is a stopper.

Moreover, in Japanese Unexamined Patent Application No. Showa 61-134555 (Patent Reference 2), for example, an adjustment device is disclosed in which the adjustment valves in the main fuel path and the low-speed fuel path are placed close to and parallel with each other, and they can be only operated within one rotation due to an arm on each one touching the other adjustment valve, which is a stopper, or a limit cap.

In these conventional adjustment devices, the limit caps are temporarily fitted to such a degree that they do not drop off the head before the manufacturer adjusts them, and the main fitting is done in a position such that the arm touches the stopper when the adjustment is finished, or they are fitted in a position in which the arm touches the stopper after the manufacturer's adjustment, without a temporary fitting.

However, the limit caps which are a means of limiting these rotations are exposed to the outside of the main carburetor body. Therefore, they have the problems that they are easily removed by intentional vandalism of the users, or the adjustments may slip due to the user unintentionally touching the device during the adjustment.

Therefore, for example, in the pilot screw (adjustment valve) adjustment device for carburetors which is shown in Japanese Utility Model No. Heisei 6-40339 (Patent Reference 3), as shown in FIGS. 14A and 14B, the screw part of the adjustment valve 1*a* which adjusts the effective opening area of the fuel flow path is attached by screwing it into the adjustment hole 3*a* of the main carburetor body 2, and an adjustment tool is made so that it can be inserted into the tool insertion groove 11*a* of the adjustment valve 1*a* through the regulating hole 41*a* of the regulating member 4*a*.

By rotating the adjustment tool inserted into the tool insertion groove 11*a*, the adjustment valve 1*a* is rotated, and the effective opening area of the fuel flow path is variably adjusted by rotating the adjustment valve 1*a*. Thus, the rotation of the adjustment valve 1*a* is limited to a specific adjustment range by the fact that the side surface of a semicircular flange part touches the locking part 42*a* of the regulating member 4*a*.

In the adjustment device of this adjustment valve, the adjustment valve 1*a* and the regulating member 4*a* are disposed in a sleeve 5*a*. In a carburetor which has a regulating valve of the fuel flow quantity and a control means for this regulating valve, it can be made difficult to remove the device by the user's intentional vandalism performed on the aforementioned regulating member which is disposed in this sleeve.

However, the adjustment device of the adjustment valve in this carburetor uses a flat-plate-shaped regulating member as the means of control, and the regulating member limits removal by being inserted into and fixed in a storage hole. However, since it is formed as a flat plate, it must be pressed in or fastened, or, for example, fixed by using a separate means of fixing, such as a screw, when it is pressed into and fixed in the storage hole.

Therefore, it is difficult to make the limit cap small and the parts are costly. Furthermore, it has problems in its operation, namely, that it is hard to make it difficult for users to remove it, and it is easily removed during adjustment, etc.

Documents of the Related Art

1. Japanese Patent No. 47-42424
2. Japanese Unexamined Patent Application No. 61-134555
3. Japanese Unexamined Patent Application No. 6-40339

SUMMARY

Problem to Be Solved

The problem this embodiment addressed herein is to provide an adjustment device of the adjustment valves in carburetors which is provided with a small, inexpensive limit cap which can be easily assembled without increasing the number of parts and which prevents the user's intentional and forceful removal by over-operation or destruction, and can solve the problems in the operations of manufacturers and users.

Means for Solving the Problem

The embodiment disclosed herein to solve the problem mentioned above is an adjustment device of adjustment valves in carburetors which adjust the effective area of the fuel path by being screwed into an adjustment hole which communicates with the fuel path formed in the main carburetor body. This adjustment of the effective area of the fuel path is performed by moving the device in the axial direction by rotating it by a tool insertion groove which is formed in a head of the adjustment valve. The adjustment device includes a tubular limit cap and a sleeve. The limit cap has an insertion hole which allows the adjustment valve to be rotatably inserted into the center of the tip surface of the limit cap, as well as flange-shaped engaging and protruding pieces in the insertion hole which engage with engaging grooves formed in a shaft part of the adjustment valve and limit the adjustment valve to a specific range of rotation. A circumferential locking part is formed having a knurling which extends in the longitudinal direction on the circumferential surface of the limit cap and the sleeve. An inner circumferential locking part formed in the bottom of the inner circumferential surface of the sleeve engages with and locks with the outer circumferential engaging part of the aforementioned limit cap. The aforementioned adjustment valve and the aforementioned limit cap are inserted movably in the axial direction in the sleeve. The aforementioned engaging grooves include two engaging grooves, a first and a second engaging groove, which are formed in specific axial positions along the length of the aforementioned shaft part from the base end to the tip end. In addition, the aforementioned engaging and protruding pieces formed in the insertion hole of the limit cap engage with the aforementioned first engaging groove and keep the limit cap in an axial position such that the aforementioned outer circumference locking part does not lock with the inner circumference locking part of the aforementioned sleeve. These comprise a first engaging and protruding piece which keeps the limiting cap in a first step position, in which it can move freely in the circumferential direction, and a second engaging and protruding piece which engages with the aforementioned second engaging groove when the limit cap has been pressed in the lower direction from the aforementioned first step position, locks the outer circumference locking part of the limit cap with the inner circumferential locking part of the sleeve, obstructs its rotation, and limits the range of rotation of the adjustment valve in the aforementioned insertion hole to a previously set range.

By means of this embodiment, the aforementioned first engaging and protruding piece which was formed in the insertion hole of the limit cap engages with the first engaging groove of the adjustment valve and keeps the limit cap in the adjustment valve in a position such that the outer circumference locking part of the limit cap comes to be in an axial position in which it is not locked to the inner circumference locking part in the sleeve. That is, in the first step position, in which the rotation of the limit cap in the sleeve is in a free state, it is adjusted by the manufacturer to an optimal position in the range which conforms to the exhaust regulations. Furthermore, the device is shipped with the limit cap disposed in the second step position, in which the limit cap has been pushed in, the outer circumference locking part of the limit cap is locked into the inner circumference locking part of the sleeve, and the rotation of the limit cap in the sleeve is limited, and the second engaging and protruding piece is engaged in the second engaging groove formed in the shaft of the adjustment valve. The rotation of the aforementioned adjustment valve, which is engaged in the second engaging groove which was formed in the shaft of the adjustment valve, is limited to a specific angle. If necessary, the user can make an adjustment by rotating the adjustment valve in the angular range which is in the aforementioned second step position.

In this embodiment, moreover, the part of the aforementioned adjustment valve which is inserted into the insertion hole of the aforementioned limit cap has a semicircular rod shape. The part of the aforementioned adjustment valve which is inserted into the insertion hole of the limit cap has an arc-shaped horizontal cross section, and the insertion hole formed in the aforementioned limit cap has an arc-shaped insertion hole part into which the inserted part of the aforementioned adjustment valve is inserted, and an arc-shaped movement hole part connected and coaxial with the insertion hole part and has the same diameter. The first engaging and protruding piece which engages with the first engaging groove which is formed in the aforementioned adjustment valve protrudes into the arc-shaped part of the aforementioned insertion hole part, and the second engaging and protruding part which engages with the second engaging groove which is formed in the aforementioned adjustment valve protrudes into the arc-shaped part of the aforementioned movement hole part. The range of rotation of the aforementioned adjustment valve can be limited by forming a stopper in one end, or stoppers in both ends, of the aforementioned insertion hole part and movement hole part.

Moreover, in another embodiment, in the part inserted into the limit cap, from the head of the aforementioned adjustment valve to the second engaging groove, the horizontal cross section in the axial direction presents the shape of an approximately oval horizontal cross section, with arcs formed in both ends of the horizontal direction and approximately equal to the diameter of the insertion hole which is formed in the tip surface of the limit cap. The limit cap presents an insertion hole with the same oval shape as the oval shape which is the horizontal cross section of the adjustment valve which was formed in the shaft and coaxial with it. Due to the fact that it is inserted with the aforementioned adjustment valve, the first engaging and protruding piece which has a protruding piece shape engages with the first engaging groove in order to temporarily fix the aforementioned limit cap and prevent it from easily falling off; the first engaging and protruding piece protrudes into the arc parts on both sides of the aforementioned insertion hole. The movement hole of the limit cap is formed by the second engaging and protruding piece, which engages with a pair of second engagement grooves which are disposed in symmetrical positions, forming an oval-shaped insertion hole which engages with the second engaging groove of the aforementioned adjustment valve. The range of rotation of the aforementioned adjustment valve can also be limited by forming a stopper on the back side of the aforementioned second engaging and protruding piece.

Furthermore, in this embodiment, the aforementioned first engaging and protruding piece and second engaging and protruding piece, which are formed on the aforementioned limit cap, are formed in axial positions close to each other; in the aforementioned second-step position, the aforementioned first and second engaging protrusion pieces engage with the aforementioned second engaging groove and can exhibit a retaining effect.

Furthermore, in this embodiment, the aforementioned adjustment valve can also be applied to at least one of a high-speed side adjustment valve and a low-speed side adjustment valve which are screwed, respectively, into a high-speed side adjustment hole and a low-speed side adjustment hole placed close to each other in the aforementioned main carburetor body and which communicate with the high-speed side fuel flow path and the low-speed side fuel flow path formed in the aforementioned main carburetor body.

Effect of the Embodiment

By means of this embodiment, in a carburetor which is suitable for feeding fuel to general-purpose engines and has an adjustment valve for the fuel flow quantity and a means for controlling that adjustment valve, not only is the generation of additional parts avoided, the procedure of assembly does not differ greatly from the prior art, and it is made very difficult for the user to remove the aforementioned cap, which is disposed in the aforementioned sleeve in the working embodiments, by intentional vandalism, and the size of the limiting cap can be made smaller and its cost can be reduced.

BRIEF DESCRIPTION OF THE DRAWINGS

The details of the example embodiments, including structure and operation, may be gleaned in part by study of the accompanying figures, in which like reference numerals refer to like parts. The components in the figures are not necessarily to scale, emphasis instead being placed upon illustrating the principles. Moreover, all illustrations are intended to convey concepts, where relative sizes, shapes and other detailed attributes may be illustrated schematically rather than literally or precisely.

FIG. 3A showing the first step position; FIG. 3B showing the second step position.

FIG. 5A is a perspective view from the front side; FIG. 5B is a perspective view from the back side.

FIG. 8A shows the state in which the limit cap is in the first step position; FIG. 8B shows the state in which the limit cap is in an intermediate step position; and, FIG. 8C shows the state in which the limit cap is in the second step position.

FIG. 9A is an explanatory drawing in which the adjustment valve is disposed in a state in which it can only be rotated in the direction of decreasing the fuel flow quantity; FIG. 9B is an explanatory drawing in which the adjustment valve is disposed in a state in which it can only be rotated in the direction of increasing the fuel flow quantity; FIG. 9C is an explanatory drawing in which the adjustment valve is disposed in a state in which it can be rotated in both the directions of increasing and decreasing the fuel flow quantity.

FIG. 11A is a perspective view from the front side; FIG. 11B is a perspective view from the back side.

FIG. 14A is an outline drawing; FIG. 14B is a perspective view showing the pilot screw (adjustment valve) and regulating member.

It should be noted that the figures are not necessarily drawn to scale and that elements of similar structures or functions are generally represented by like reference numerals for illustrative purposes throughout the figures.

DESCRIPTION OF THE PREFERRED EMBODIMENT

FIGS. 1-9 show desirable working embodiments; these working embodiments will be explained below with reference to these drawings.

Figure 1:
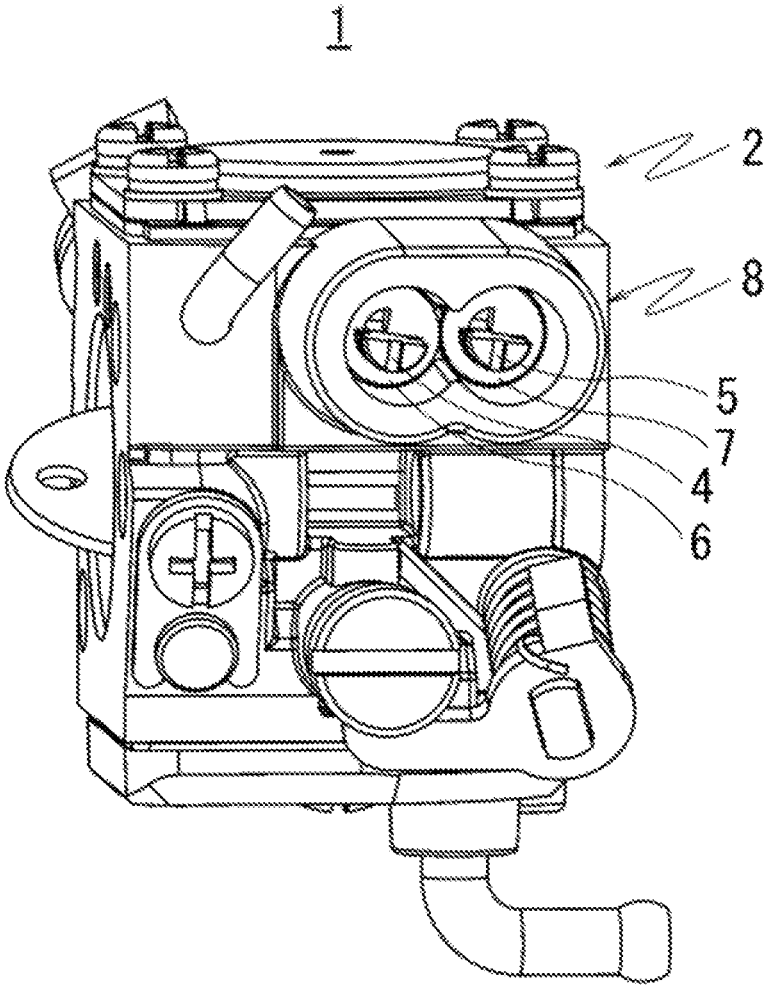
FIG. 1 is a perspective view showing a carburetor in which a desirable working embodiment is applied.
Figure 2:
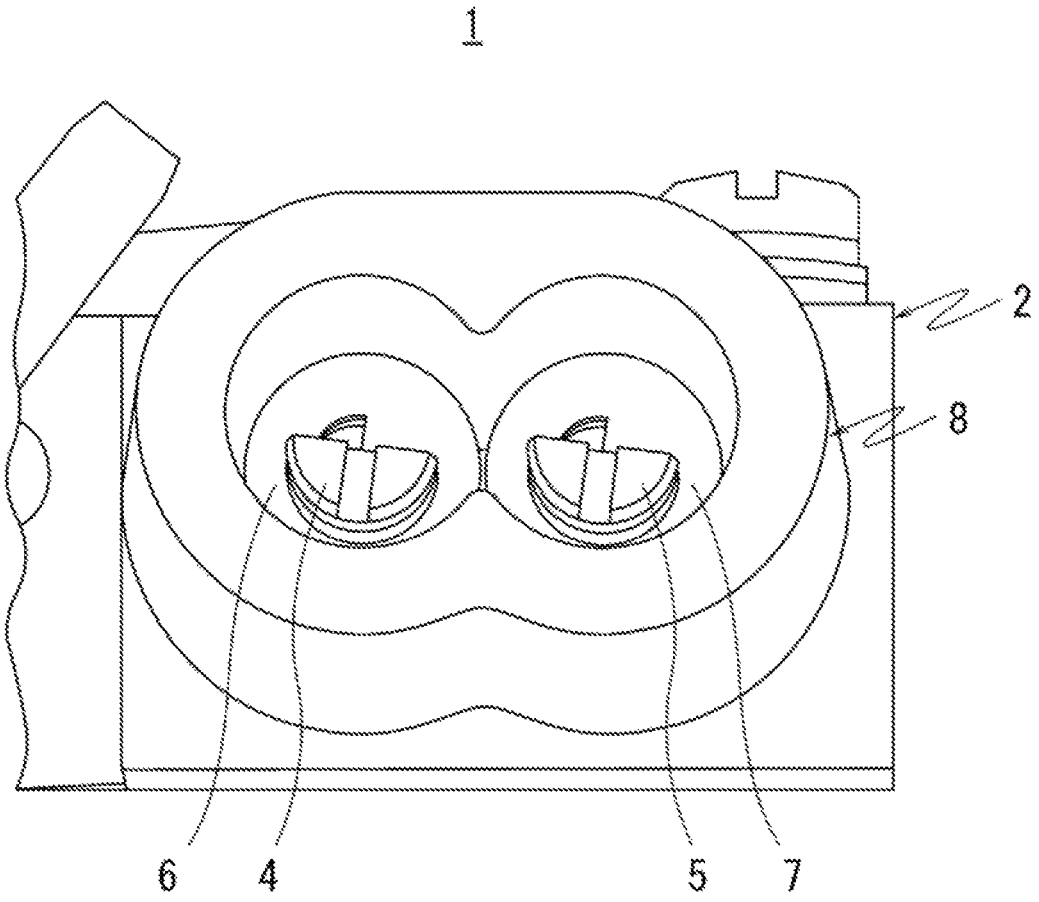
FIG. 2 is a perspective view showing a desirable working embodiment which is used in the carburetor shown in FIG. 1.
Figure 3A:
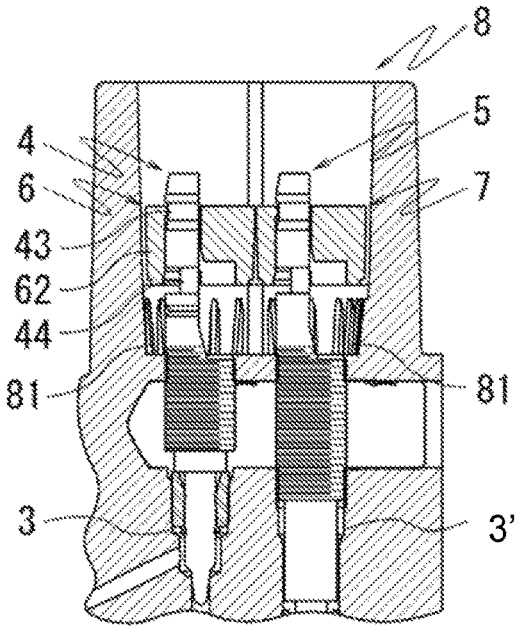
FIGS. 3A and 3B are cross-sectional views showing the state of use in the desirable working embodiment shown in FIG. 2.
Figure 3B:
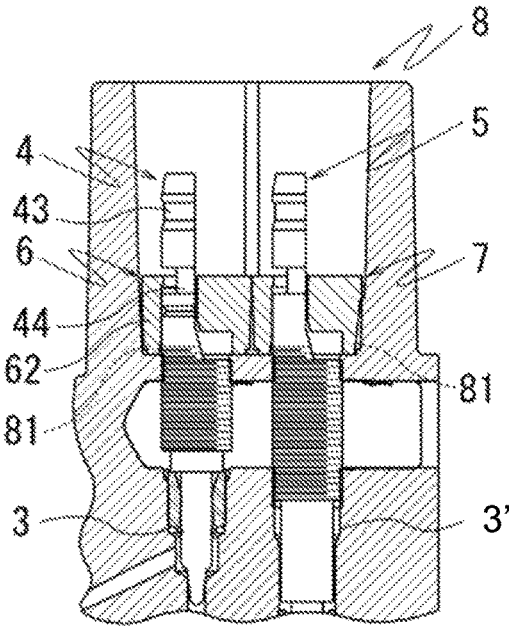

FIG. 1 is a perspective view showing a carburetor 1 in which a desirable working embodiment is applied, and FIG. 2 is a perspective view showing the desirable working embodiment used in the carburetor 1 shown in FIG. 1. This carburetor 1 has a sleeve 8 which is set around the adjustment holes 3, 3', which are placed close to each other and communicate with the high-speed and low-speed side fuel flow paths which are formed in the main carburetor body 2, as shown in FIGS. 3A and 3B. It also has a high-speed side adjustment valve 4 and a low-speed adjustment valve 5, which are connected movably by being screwed into the aforementioned adjustment holes 3, 3' in order to adjust the effective areas of these fuel paths by hand individually, and a high-speed side limit cap 6 and a low-speed limit cap 7, which are connected to these adjustment valves 4, 5 as means for controlling them.

Furthermore, although the high-speed side adjustment valve 4 and the low-speed side adjustment valve 5 differ in the axial lengths of some of their constituent elements, they are the same in function and the high-speed side limit cap 6 and the low-speed side limit cap 7 have the same parts; therefore, this embodiment can be used in the same way in both the high-speed side adjustment valve 4 and the low-speed side adjustment valve 5, and the explanation below will deal with the high-speed side adjustment valve 4 and the high-speed side limit cap 6.

The adjustment device of the adjustment valve 4 in this working embodiment is constituted primarily by the aforementioned adjustment valve 4; a tubular limit cap 6 of the aforementioned adjustment valve 4, which has a tip side and an insertion hole 61 in the center of its tip side and which includes a knurl which extends longitudinally on its circumferential surface and which forms an outer circumference locking part 62; and a sleeve 8, which is placed surrounding the adjustment hole 3 in the aforementioned main carburetor body 2. The aforementioned adjustment valve 4 and the limit cap 6 are inserted movably in the axial direction in the sleeve 8. An inner circumference locking part 81 is formed on the lower part of the inner circumference side and includes a knurl which extends in the longitudinal direction and locks the outer circumference locking part 62 of the aforementioned limit cap 6.

Figure 4:
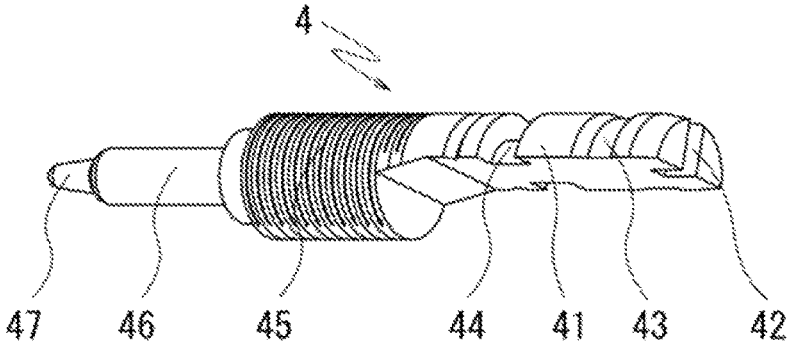
FIG. 4 is a perspective view showing an adjustment valve in the desirable working embodiment shown in FIG. 2.
Figure 5A:
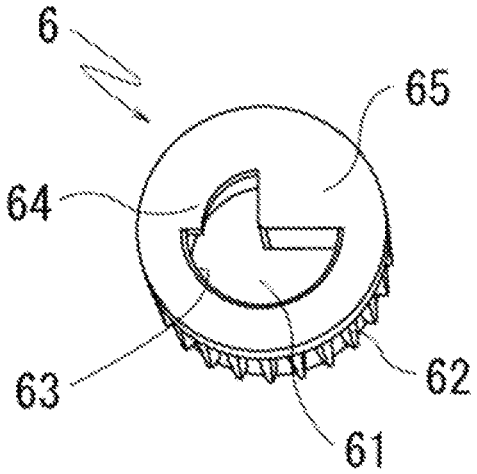
FIGS. 5A and 5B are perspective views showing the limit cap in the desirable working embodiment shown in FIG. 2.
Figure 5B:
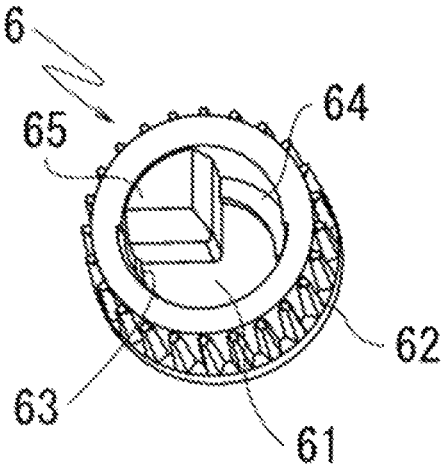

To explain this in more detail, as shown in FIG. 4, the inserted part of the shaft 41 in the aforementioned adjustment valve 4 has, for example, a rod shape with a 180° arc (semicircular) shape. A tool insertion groove 42 into which a rotating tool (not shown) can be inserted is formed in the top surface of the head of the shaft 41, and two engaging grooves, a first engaging groove 43 and a second engaging groove 44, are formed in specific positions along the length of the shaft 41 from its base to its tip.

Figure 6:
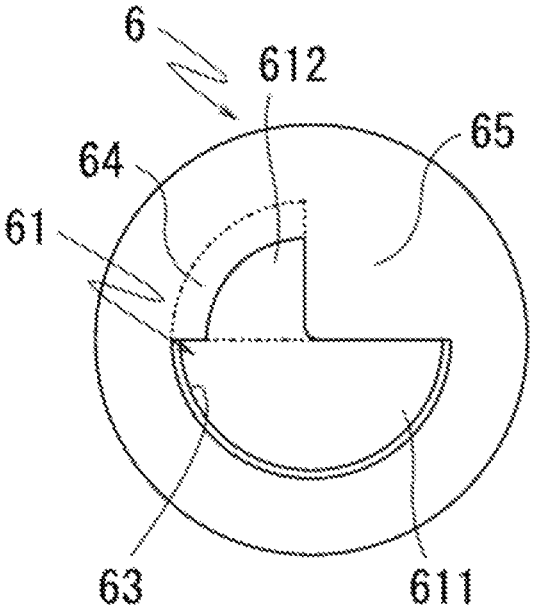
FIG. 6 is a top view of the limit cap in the desirable working embodiment shown in FIG. 2.

On the other hand, as shown in FIG. 6, the insertion hole 61 of the aforementioned limit cap 6 is composed of an arc-shaped insertion hole part 611 into which the inserted part of the adjustment valve is inserted and a concentric arc-shaped movement hole part 612 of the same diameter which is connected to the insertion hole part 611. The first engaging and protruding piece 63, which engages with the first engaging groove 43 formed in the shaft part 41 of the aforementioned adjustment valve 4, is caused to protrude into the aforementioned arc-shaped insertion hole part 611, and the second engaging and protruding piece 64, which engages with the second engaging groove 44 formed in the shaft part 41 of the aforementioned adjustment valve 4, is caused to protrude into the aforementioned arc-shaped movement hole part 612. Furthermore, stoppers 65 are formed in one end (or both ends) of the aforementioned insertion hole part 611 and the movement hole part 612.

Figure 7:
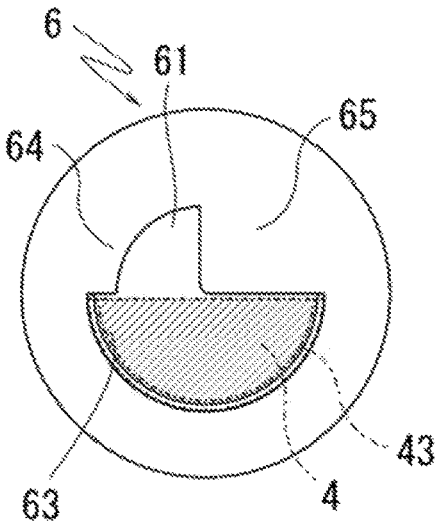
FIG. 7 is an explanatory cross-sectional view showing the state of use in the first step position of the desirable working embodiment shown in FIG. 2.
Figure 8A:
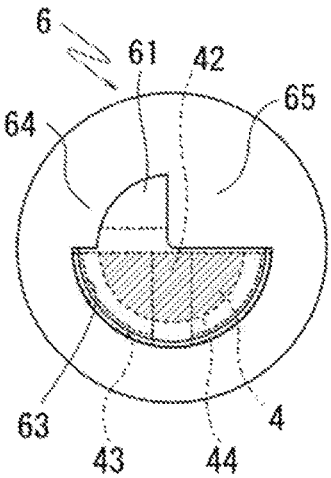
FIGS. 8A, 8B and 8C are explanatory drawings showing the situation in which the adjustment valve is rotated with the limit cap in the second step position in the desirable working embodiment shown in FIG. 2.
Figure 8B:
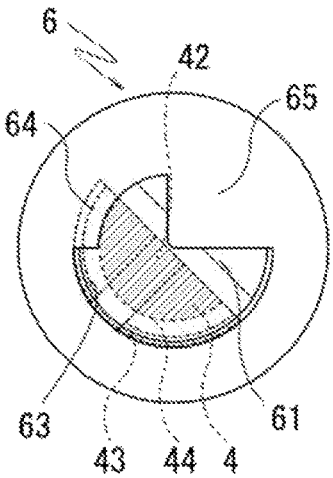
Figure 8C:
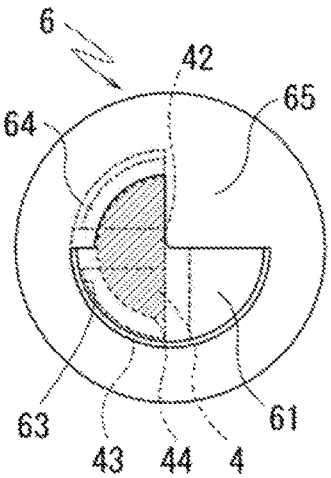
Figure 9A:
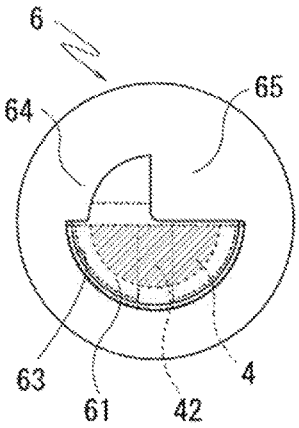
FIGS. 9A, 9B and 9C are explanatory drawings showing the range of possible rotation of the adjustment valve in the desirable working embodiment shown in FIG. 2.
Figure 9B:
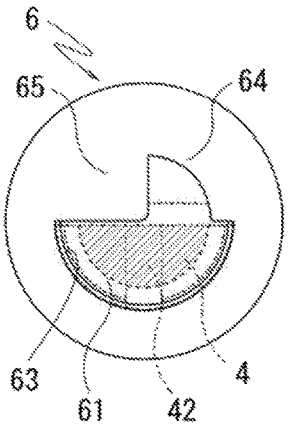
Figure 9C:
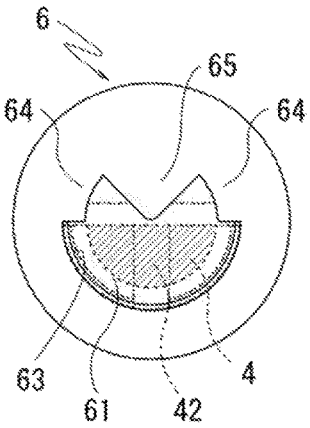

FIG. 7 presents a horizontal cross sectional view in the first engaging groove 43 of the shaft part 41 of the adjustment valve 4 when the adjustment valve 4 is caused to engage with the insertion hole part 611 of the insertion hole 61 of the limit cap 6 and the limit cap 6 is held in the first step position, which is an axial position in which the aforementioned outer circumference locking part 62, in the state shown in FIG. 3A, does not lock with the inner circumference locking part 81 of the aforementioned sleeve 8 and it can rotate freely in the circumferential direction. This is the state in which the first engaging and protruding piece 63, formed in the insertion hole part 611 of the limit cap 6 inserted from the base side of the adjustment valve 4, was pressed into and engaged with the first engaging groove 43 formed in the adjustment valve 4.

In this working embodiment, at this time, since the protruding width of the second engaging and protruding piece 64 which was formed in the arc-shaped movement hole part 612, connected to the aforementioned insertion hole part 611, is formed more widely that the protruding width of the first engaging and protruding piece 63 which was formed in the aforementioned arc-shaped insertion hole part 611, this second engaging and protruding piece 64 becomes a stopper on one rotating side, the stopper 65 becomes a stopper on the other rotating side, and the adjustment valve 4 and the limit cap 6, which is free to rotate, rotate as one. Therefore, the manufacturer holds the limit cap 6 at an axial position at which the aforementioned outer circumference locking part 62 does not lock with the inner circumference locking part 81 of the aforementioned sleeve 8, and in this way the aforementioned limit cap 6 is held in the first step position, in which it freely rotates in the circumferential direction without dropping out of the adjustment valve 4, and the adjustment valve 4 is adjusted within a specific adjustment range.

Moreover, as shown next in FIG. 3A and FIG. 3B, the limit cap 6 is pushed down from the aforementioned first step position and the first engaging and protruding piece 63 formed in the insertion hole 61 of the limit cap 6 is caused to escape from the first engaging groove 43 of the aforementioned adjustment valve 4. When the adjustment valve 4 is rotated, the second engaging and protruding piece 64 formed in the aforementioned movement hole part 612 can engage with the second engaging groove 44, and it is placed in the second step position, which is the axial position in which the outer circumference locking part 62 of the limit cap 6 is locked to the inner circumference locking part 81 of the sleeve 8 and the rotation is prevented. The device is shipped in this state.

In this embodiment, at this time, since the first engaging and protruding piece 63 formed in the insertion hole part 611 of the aforementioned limit cap 6 and the second engaging and protruding piece 64 formed in the movement hole part 612 are formed at almost the same axial position, and the protruding width of the first engaging and protruding piece 63 is formed more narrowly than the second engaging and protruding piece 64, the limit cap 6, which is in the aforementioned first step position, is pushed in until the first engaging and protruding piece 63 engages with the second engaging groove 44 of the adjustment valve. Due to this fact, not only can it be disposed in the second step position, shown in FIG. 3A and FIG. 3B, but a retaining effect is exhibited. Therefore, it is extremely difficult for the user to easily remove the limit cap 6.

In the state of this second step position, the shaft 41 of the adjustment valve 4, with a semicircular cross section, is inserted into the 270° arc-shaped insertion hole 61 which is formed by connecting the flat side of the limit cap 6 with the insertion hole part 611 and the movement hole part 612. The adjustment valve 4 can be rotated and adjusted in a 90° range by the user as shown in the drawings, which show the initial state of FIG. 8A, the state of FIG. 8B in which the adjustment valve 4 has been rotated 45° from the initial state, and the state of FIG. 8C, in which the adjustment valve 4 is rotated 90° from the initial state and the adjustment valve 4 touches the stopper 65 of the limit cap 6.

Moreover, by changing the positions of the second engaging and protruding piece 64, which engages with the second engaging groove 44 of the adjustment valve 4, and the stopper 65, the adjustment valve 4 is placed in a state in which it can only be rotated in the direction in which the fuel flow quantity is decreased (FIG. 9A), or the state in which it can be rotated only in the direction in which the fuel flow quantity is increased (FIG. 9B), or the state in which it can be rotated in both the directions in which the fuel flow quantity is increased and decreased (FIG. 9C), and the manufacturer can select them at will.

Furthermore, the materials forming the aforementioned limit cap tend not to be limited; for example, they can be selected at will from metals, plastics, or other materials.

Figure 10:
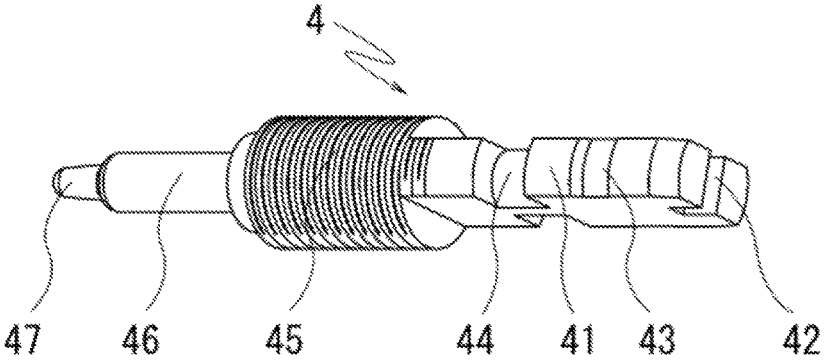
FIG. 10 is an enlarged perspective drawing showing the adjustment valve in a different working embodiment this embodiment.
Figure 11A:
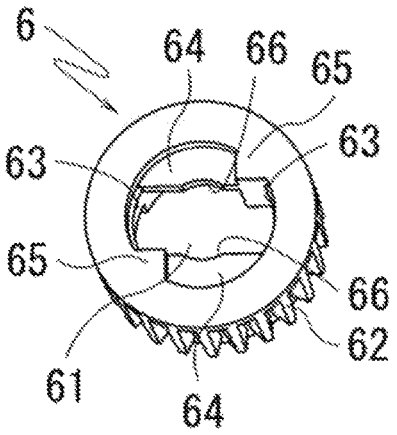
FIGS. 11A and 11B are perspective drawings showing the limit cap used in the adjustment valve in the working embodiment shown in FIG. 10.
Figure 11B:
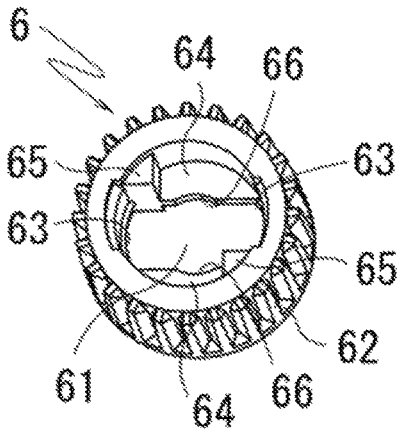

FIGS. 10, 11A, and 11B show perspective views of the adjustment valve 4 and the limit cap 6 in another working embodiment.

The main carburetor body 2 and the sleeve 8 in this working embodiment are the same as those of the desirable working embodiment shown in FIG. 1 above; therefore, explanations of the same constituent parts and the operations and effectiveness will be omitted.

The aforementioned adjustment valve 4 in this working embodiment has a tool insertion groove 42 formed in the head of the shaft 41; a first engaging groove 43 for preventing the aforementioned limit cap 6 from dropping off, which engages the first engaging and protruding piece 63 of the aforementioned limit cap 6 is formed on the tip end side at the other end from the aforementioned head part; a second engaging groove 44, formed on the tip end side of the aforementioned first engaging groove 43; a screw part 45 which screws into the adjustment hole 3 of the aforementioned main carburetor body 2, which is formed on the tip end side from the aforementioned second engaging groove 44, and which connects them so that they can move in the axial direction; a seal part 46 which is formed on the tip end side from the aforementioned screw part 45 and prevents the fuel from accidently flowing outside from the aforementioned adjustment hole 3; and a needle part 47 which is formed at the tip end for increasing and decreasing the effective area of the fuel flow path and adjusting the fuel flow quantity.

Above all, the horizontal cross section in the axial direction of the part which is inserted into the limit cap 6, from the head of the aforementioned adjustment valve 4 to the second engaging groove 44, presents an approximately oval shape in its horizontal cross section in which arcs approximately equal to the diameter of the insertion hole 61 which is formed on the top surface of the limit cap 6 are formed on both ends in the horizontal direction.

Moreover, as shown in FIGS. 11A and 11B, the limit cap 6, presents an oval insertion hole 61 which is coaxial with and has the same shape as the oval shape which is the horizontal cross section of the adjustment valve 4 shown in FIG. 10 above, formed in the axial direction. Due to the fact that it fits with the aforementioned inserted adjustment valve 4, the first engaging and protruding pieces 63, 63 which have a protruding piece shape, which are engaged with the first engaging groove 43 for temporarily fixing the aforementioned limit cap 6 and preventing it from easily dropping off, are disposed in a state in which they protrude into the arc-shaped parts on both sides of the aforementioned insertion hole 61.

Moreover, the insertion hole 61 of the limit cap 6 is formed by the second engaging and protruding pieces 64, 64 which engage with a pair of second engaging grooves 44, 44 disposed in symmetrical positions and form an oval-shaped insertion hole 61 which engages with the second engaging groove 44 of the aforementioned adjustment valve 4, and two block-shaped stoppers 65, 65 are placed on the back sides of the aforementioned second engaging and protruding pieces 64, 64.

In this kind of working embodiment, the limit cap 6 is first pushed in until the first engaging and protruding pieces 63, 63 which are formed in arc shapes are pressed and engage with the first engaging grooves 43, 43 which were formed in the shaft 41 of the adjustment valve 4 in the insertion hole 61 of the aforementioned adjustment valve 4. The limit cap 6 is kept in the first step position, an axial position at which the aforementioned outer circumference locking part 62 does not lock with the inner circumference locking part 81 of the aforementioned sleeve 8 and it is made able to rotate freely in the circumferential direction.

Figure 12:
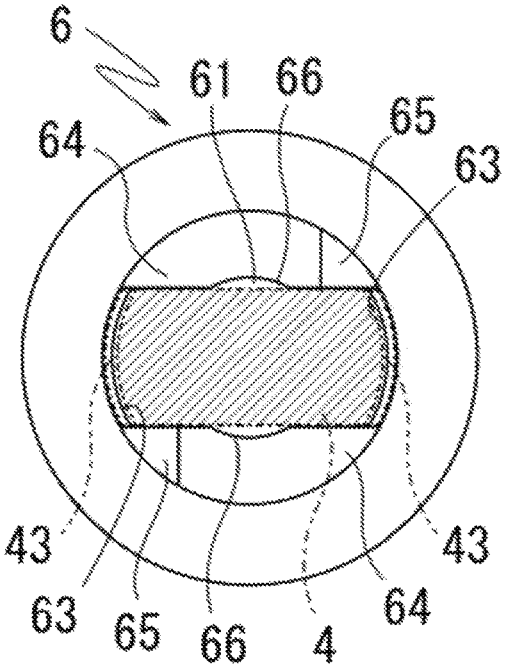
FIG. 12 is an explanatory cross sectional view showing the state of use in the first step position in the desirable working embodiment shown in FIG. 10.

FIG. 12 shows a horizontal cross sectional view in the shaft part 41 of the adjustment valve 4 when the first engaging groove 43 of the adjustment valve 4 engages with the insertion hole 61 of the limit cap 6 and the limit cap 6 is held in the first step position, the axial position in which the aforementioned outer circumference locking part 62 does not lock with the inner circumference locking part 81 of the aforementioned sleeve 8 and can freely rotate in the circumferential direction. This is the state in which the first engaging and protruding piece 63 formed in the insertion hole 61 of the limit cap 6, inserted from the base side of the adjustment valve, is pressed and engaged with the first engaging groove 43 formed in the adjustment valve 4.

In this working embodiment, at this time, since the protruding width of the first engaging and protruding piece 63 which is formed in the arc-shaped part of the aforementioned insertion hole 61 is formed more widely than the protruding widths of the second engaging and protruding pieces 64, 64, these second engaging and protruding pieces 64, 64 become stoppers on both rotating sides and the adjustment valve 4 and the limit cap 6 which rotates freely rotate as one. Therefore, the manufacturer keeps the limit cap 6 at the axial position at which the aforementioned outer circumference locking part 62 does not lock with the inner circumference locking part 81 of the aforementioned sleeve 8, so that the aforementioned limit cap 6 is held in the first step position, at which it can rotate freely in the circumferential direction without dropping from the adjustment valve 4, and the adjustment valve 4 is adjusted in a specific adjustment range.

Moreover, after it is adjusted in the specific adjustment range, the limit cap 6 is pushed down from the aforementioned first step position; the first engaging and protruding pieces 63, 63 formed in the insertion hole 61 of the limit cap 6 are made to escape from the first engaging groove 43 of the aforementioned adjustment valve 4, and when the adjustment valve 4 has been rotated, the second engaging and protruding pieces 64, 64 which form the aforementioned insertion hole 61 can engage the second engaging groove 44. It is put into the second step position, an axial position at which the outer circumference locking part 62 of the limit cap 6 is locked to the inner circumference locking part 81 of the sleeve 8 and rotation is prevented, and the device is shipped.

In this working embodiment, the first engaging and protruding piece 63 and the second engaging and protruding piece 64 which were formed in the insertion hole 61 of the aforementioned limit cap 6 are formed at almost the same axial position, and the protruding width of the first engaging and protruding piece 63 is formed narrower than that of the second engaging and protruding piece 64. Therefore, by pushing the limit cap 1 into the aforementioned first step position until the first engaging and protruding piece 63 engages with the second engaging groove 44 of the adjustment valve 4, not only can it be disposed in the second step position, but a restraining effect is exhibited. Therefore, it is extremely difficult for the user to easily remove the limit cap 6.

Figure 13A:
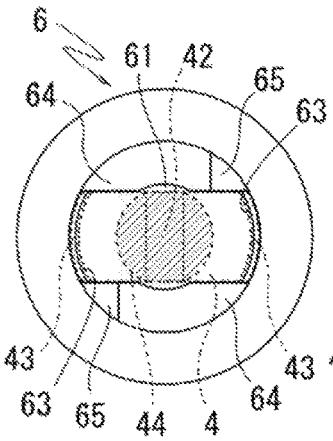
FIGS. 13A, 13B and 13C are explanatory drawing showing the situation in which the adjustment valve is rotated in the state with the limit cap in the second step position in the working embodiment shown in FIG. 10.
Figure 13B:
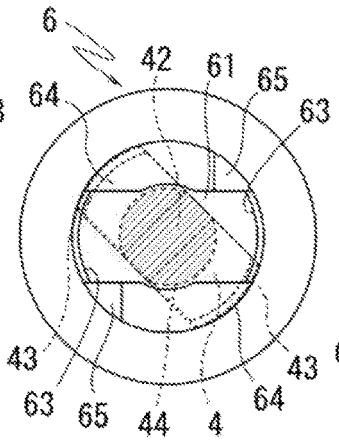
Figure 13C:
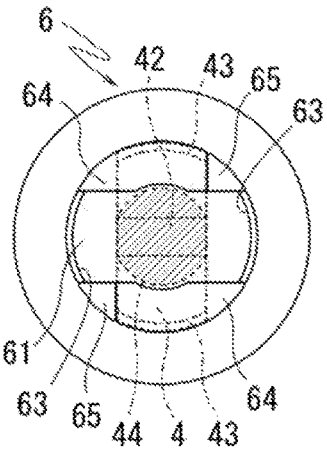
Figure 14A:
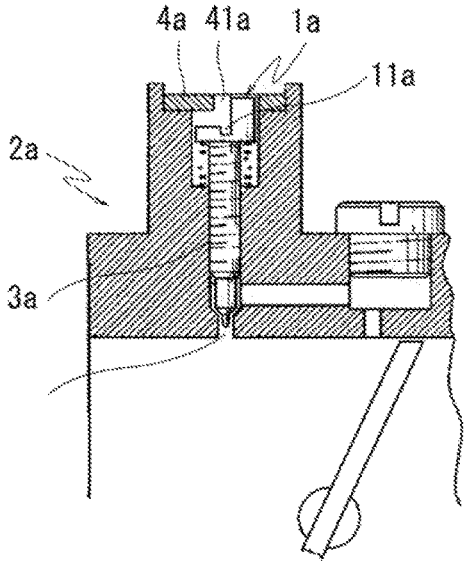
FIGS. 14A and 14B are explanatory drawings showing an example of the prior art.
Figure 14B:
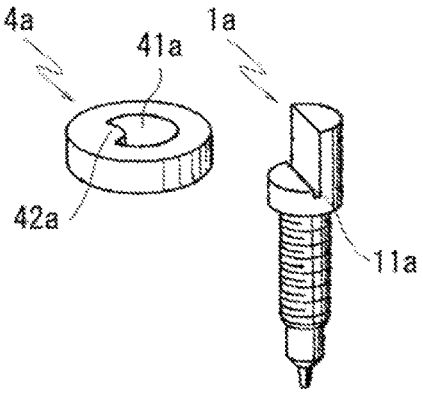

FIGS. 13A, 13B and 13C is an explanatory drawing which shows the situations of the rotation of the aforementioned adjustment valve 4 in the second step position in this working embodiment; FIG. 13A shows the initial state; FIG.

13B shows the state in which the adjustment valve 4 has been rotated 45° from the initial state; and FIG. 13C shows the state in which the adjustment valve 4 has been rotated 90° from the initial state and the adjustment valve 4 touches the stoppers 65, 65 of the limit cap 6.

In this working embodiment, when the aforementioned adjustment valve 4 is rotated in the circumferential direction in the second step position into which the limit cap 6 was pressed, the aforementioned adjustment valve 4 touches the block-shaped stoppers 65, formed in the aforementioned limit cap 6; therefore, the rotation of the aforementioned adjustment valve 4 is limited to a 90° range of rotation.

According to this embodiment, there is the advantage that, unlike the adjustment valve in the working embodiment that was shown in FIGS. 1-9, the center of the tool insertion groove formed in the head of the adjustment valve agrees with the axial center of the adjustment valve and therefore the user can rotate the adjustment valve easily with a general-purpose driver, and the usefulness for the user can be increased.

Furthermore, in this working embodiment, a pair of arc-shaped cut-out parts 66, 66 are placed opposite each other so that the axial part 41 of the second engaging groove 44 of the aforementioned adjustment valve 4 is inserted in the center of the straight-line part of the aforementioned oval insertion hole 61, and a smooth rotation is made possible, without obstruction, when the adjustment valve 4 is rotated coaxially with the insertion hole 61 in the second step position.

As mentioned above, by means of this embodiment, in a carburetor suitable for feeding fuel to a general-purpose engine which has an adjustment valve for the quantity of fuel flow and a means for controlling this adjustment valve, the generation of additional parts is avoided, the assembly procedure is not greatly changed from the prior art, and removal of the aforementioned cap which is placed in the aforementioned sleeve by the user's intentional vandalism can be made very difficult in the working embodiments.

DESCRIPTION OF THE REFERENCE NUMERALS

1 Carburetor
2 Main carburetor body
3 Adjustment hole
4 Adjustment valve
5 Adjustment valve
6 Limit cap
7 Limit cap
8 Sleeve
41 Shaft
42 Tool insertion groove
43 First engaging groove
44 Second engaging groove
45 Screw part
46 Seal part
47 Needle part
53 First engaging groove
54 Second engaging groove
61 Insertion hole
62 Outer circumference locking part
63 First engaging and protruding piece
64 Second engaging and protruding piece
65 Stopper
66 Cut-out part
81 Inner circumference locking part
611 Insertion hole part
612 Movement hole part In the foregoing specification, all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. Express recitation of every possible combination and substitution is overly burdensome, especially given that the permissibility of each and every such combination and substitution will be readily recognized by those of ordinary skill in the art upon reading this description.

In many instances entities are described herein as being coupled to other entities. It should be understood that the terms "coupled" and "connected" (or any of their forms) are used interchangeably herein and, in both cases, are generic to the direct coupling of two entities (without any non-negligible intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the above is a complete description of exemplary specific embodiments, additional embodiments are also possible. Thus, the above description should not be taken as limiting the scope of the invention, which is defined by the appended claims along with their full scope of equivalents.

What is claimed is:

1. An adjustment device for an adjustment valve in a carburetor, wherein the adjustment valve is screwed into an adjustment hole which communicates with a fuel path formed in a main carburetor body and which adjusts an effective area of the fuel path by being moved in the axial direction by rotating a shaft part by a tool insertion groove formed in a head part of the adjustment valve, the adjust device comprising:

a tubular limit cap having an insertion hole in the center of a tip surface to rotatably insert the adjustment valve, flange-shaped protruding pieces in the insertion hole that engage grooves formed in the shaft of the adjustment valve and which limit the adjustment valve to a specific range of rotation, and an outer circumferential locking part having a knurl which extends in the longitudinal direction on an outer circumferential surface, and a sleeve placed around the adjustment hole in the main carburetor body, wherein the adjustment valve and the limit cap are inserted in the sleeve and are moveable in the axial direction, wherein the sleeve includes an inner circumferential locking part comprising a knurl that extends in the longitudinal direction, the inner circumferential locking part locks with the outer circumferential locking part of the limit cap on the bottom of the inner circumferential surface;

wherein the grooves of the adjustment valve includes two engaging grooves, a first engaging groove and a second engaging groove, which are formed specific axial positions along the length from the base end of the shaft to its tip end; the protruding pieces are formed in the insertion hole of the limit cap and comprise a first protruding piece which engages with the first engaging groove and keeps the limit cap in a first step position in which the outer circumferential locking part does not lock with the inner circumferential locking part of the sleeve leaving the limit cap to rotate freely in the circumferential direction, and a second protruding piece which engages with the second engaging groove when the limit cap is pushed down from the said first step position and holds it in the second step position, in which the outer circumferential locking part of the limit cap locks with the inner circumferential locking part of the sleeve, limiting the range of rotation of the adjustment valve in the insertion hole to a predetermined range.

2. The adjustment device in accordance with claim 1, wherein the inserted part of the adjustment valve inserted into the insertion hole has a semicircular rod shape which has an arc-shaped horizontal cross section; the insertion hole formed in said limit cap comprises an arc-shaped insertion hole part, into which the inserted part of the adjustment valve is inserted coaxially, and an arc-shaped movement hole part which is connected and coaxial with the insertion hole part, and has the same diameter; the first protruding piece, which engages with the first engaging groove formed in said adjustment valve, protrudes into the arc-shaped insertion hole part, and the second protruding piece, which engages with the second engaging groove formed in the adjustment valve, protrudes into the arc-shaped part of the movement hole part; and stoppers which can limit the range of rotation of the adjustment valve are formed in one or both ends of said insertion hole part and movement hole part.

3. The adjustment device in accordance with claim 1, wherein the part of the adjustment valve inserted into the limit cap, from the head of the adjustment valve to the second engaging groove, presents a horizontal cross section in the axial direction, with an approximately oval-shaped horizontal cross section with arcs formed on both ends in the horizontal direction and with a diameter which is approximately equal to the diameter of the insertion hole formed in the tip surface of the limit cap; the limit cap presents an oval insertion hole which is coaxial with and has the same shape as the oval shaped of the horizontal cross section of the adjustment valve formed in the axial direction; the horizontal cross section of the adjustment valve is formed by a first protruding piece with a protruding shape which engages with the first engaging groove in order to temporarily fix the limit cap by inserting the adjustment valve and prevent it from dropping off and which protrudes into the arc-shaped parts on both sides of the insertion hole, and a second protruding piece which engages with a pair of second engaging grooves which are disposed in symmetrical positions which make oval insertion holes which engage with the second engaging grooves of said adjustment valve; and stoppers are formed on the back side of said second engaging and protruding piece.

4. The adjustment device in accordance with claim 1, wherein the first and second protruding pieces formed in the limit cap are formed in axial positions which are close to each other, and the said first and second engaging and protruding pieces engage with the second engaging groove in the second step position and exhibit a restraining effect.

5. The adjustment device in accordance with claim 2, wherein the first and second protruding pieces formed in the limit cap are formed in axial positions which are close to each other, and the said first and second engaging and protruding pieces engage with the second engaging groove in the second step position and exhibit a restraining effect.

6. The adjustment device in accordance with claim 3, wherein the first and second protruding pieces formed in the limit cap are formed in axial positions which are close to each other, and the said first and second engaging and protruding pieces engage with the second engaging groove in the second step position and exhibit a restraining effect.

7. The adjustment device in accordance with claim 1, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

8. The adjustment device in accordance with claim 2, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

9. The adjustment device in accordance with claim 3, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

10. The adjustment device in accordance with claim 4, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

11. The adjustment device in accordance with claim 5, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

12. The adjustment device in accordance with claim 6, wherein the adjustment valve is at least one of a high-speed side adjustment valve and a low-speed side adjustment valve, which are screwed into a high-speed side adjustment hole and a low-speed side adjustment hole which communicate with the high-speed side fuel flow path and the low-speed side fuel flow path formed in said main carburetor body and are placed near each other in said main carburetor body.

* * * * *